US005857411A

United States Patent [19]

Carsel

[11] Patent Number: 5,857,411

[45] Date of Patent: Jan. 12, 1999

[54] WALL DECORATION PAINT APPLYING DEVICE

[76] Inventor: Dale Anthony Carsel, 8316 Montello Rd., Independence, Ohio 44131

[21] Appl. No.: 783,603

[22] Filed: Jan. 14, 1997

[51] Int. Cl.[6] ..... B41K 1/02; A47K 7/02; B43K 8/12

[52] U.S. Cl. ..... 101/333; 401/196; 401/207; 101/401.1; 101/405; 15/244.1

[58] Field of Search ..... 101/405, 406, 101/379, 380, 368, 333, 382.1, 401.1; 15/244.1, 244.2, 244.3, 244.4; 401/6, 88, 118, 130, 138, 139, 196, 198, 206, 207, 261, 262, 266

[56] References Cited

U.S. PATENT DOCUMENTS

| | | | |
|---|---|---|---|
| D. 378,597 | 3/1997 | Harden | 101/406 |
| 774,675 | 11/1904 | Kendrick | 101/406 |
| 994,971 | 6/1911 | Beck | 101/379 |
| 1,640,414 | 8/1927 | Lake | 101/406 |
| 1,908,237 | 5/1933 | Hampson . | |
| 2,143,833 | 1/1939 | Moss | 101/379 |
| 2,567,764 | 9/1951 | Davies | 401/207 |
| 2,708,763 | 5/1955 | Jacoby . | |
| 2,899,895 | 8/1959 | Tannery | 101/405 |
| 3,131,410 | 5/1964 | Anderson et al. | 15/244.1 |
| 3,142,082 | 7/1964 | Harwood . | |
| 3,180,260 | 4/1965 | Joseph . | |
| 3,204,278 | 9/1965 | Lambros . | |
| 3,209,686 | 10/1965 | Arthurs . | |
| 3,338,162 | 8/1967 | Davis | 101/379 |
| 3,471,245 | 10/1969 | Schwartzman | 401/207 |
| 3,565,294 | 2/1971 | Schwartzman | 401/196 |
| 3,785,000 | 1/1974 | Zacha et al. . | |
| 3,817,178 | 6/1974 | Hagen | 101/379 |
| 3,843,992 | 10/1974 | Briggs . | |
| 3,905,848 | 9/1975 | Williams . | |
| 4,030,414 | 6/1977 | McGuire . | |
| 4,123,973 | 11/1978 | Genevase | 101/379 |
| 4,137,846 | 2/1979 | Russebo | 101/406 |
| 4,225,253 | 9/1980 | Fraleigh . | |
| 4,375,191 | 3/1983 | Dickey . | |
| 4,594,015 | 6/1986 | Pomares . | |
| 4,728,210 | 3/1988 | Barish et al. | 401/88 |
| 4,924,773 | 5/1990 | Gwilliam . | |
| 5,431,098 | 7/1995 | Winston . | |
| 5,500,049 | 3/1996 | Kulinsky | 15/244.1 |
| 5,577,444 | 11/1996 | Toyama | 101/379 |

FOREIGN PATENT DOCUMENTS

| | | | |
|---|---|---|---|
| 2376749 | 9/1978 | France | 101/405 |
| 545459 | 7/1956 | Italy | 401/130 |
| 406432 | 3/1934 | United Kingdom | 101/379 |
| 2181390 | 4/1987 | United Kingdom | 401/207 |

*Primary Examiner*—Eugene Eickholt
*Attorney, Agent, or Firm*—Howard M. Cohn

[57] ABSTRACT

A unique two piece, hand held, device having an ergonomic and ambidextral hand holder with a detachable, and/or interchangeable, sponge-like, image imprinting element is disclosed. The imprinting element is preferably made of a unitary piece of a sponge body having an ornamental design embossed into the printing face. The embossed printing face is dipped into a paint and the paint is transferred to the desired surface by pressing the printing surface of the sponge body against the surface to be decorated.

18 Claims, 3 Drawing Sheets

WALL DECORATION PAINT APPLYING DEVICE

BACKGROUND OF THE INVENTION a) Field of the Invention

The present invention relates to an improved printing block type of stenciling device for applying decorative and ornamental designs upon a surface, such as a wall, by transfer-printing various ornamental patterns, designs and/or images upon the surface. Although I refer to the device disclosed herein as a stenciling device, it is in reality a type of printing device, typically for applying a pattern of paint onto a surface, such as a wall to simulate wallpaper.

b) Description of the Prior Art

A search of the prior art disclosed the following U.S. Patents:

| | |
|---|---|
| Hampson | U.S. Pat. No. 1,908,237 |
| Harwood | U.S. Pat. No. 3,142,082 |
| Joseph | U.S. Pat. No. 3,280,260 |
| Lambros | U.S. Pat. No. 3,204,278 |
| Zacha et. al. | U.S. Pat. No. 3,785,000 |
| Hagen | U.S. Pat. No. 3,817,178 |
| Briggs | U.S. Pat. No. 3,843,992 |
| McGuire | U.S. Pat. No. 4,030,414 |
| Winston | U.S. Pat. No. 5,431,098 |

Of the foregoing patents, teaching various stenciling devices, for imprinting a decorative and/or ornamental pattern upon a wall surface, none of the references teach a stenciling device that incorporates means for conveniently exchanging or replacing the stenciling element. Further, the foregoing references do not disclose a device that interchangeably and comfortably fits the palm of either the right or left hand whereby the palm of the hand may be effectively used to directly apply the necessary stamping pressure without stressing or otherwise cramping the fingers of the applicator's hand.

OBJECTS OF THE PRESENT INVENTION

In view of the foregoing it is an important object of the present invention to provide an ergonomic, ambidextral, hand held, wall stenciling device that is configured to comfortably and interchangeably fit either the right or left hand of a user.

It is a further object of the present invention to provide a hand held, ergonomic, wall stenciling device where the palm of the user's hand is used to apply a significant portion of the necessary stamping pressure when applying the stencil pattern upon a wall surface, preferably to simulate wallpaper.

It is another object of the present invention to provide a wall stenciling device constructed so that the stenciling element may be easily and conveniently removed, interchanged and/or replaced.

It is a further object of the present invention to provide a wall stenciling device constructed so that the stenciling element may be easily removed for cleaning and storage.

SUMMARY OF THE INVENTION

The present invention teaches a novel device for applying printed ornamental images or designs upon a surface and is particularly suitable to the wall decorating art for simulating the look of wallpaper.

A two piece, preferably hand held, device is taught comprising an ergonomic and ambidextral hand holder having a removable imprinting element attached thereto. The imprinting element is preferably made of a unitary, resilient, self-restoring, sponge body, such as for example a sponge-like open celled polyurethane foamed plastic, having a imprinting surface with a desired ornamental image or design embossed therein. The imprinting surface is typically dipped into a paint or a slurry mixture and then pressed upon the wall surface causing the image to be transferred thereto.

The hand holder comprises an open ended, generally concave, "bowl-like" configuration having a planer flange circumscribing the periphery of the opening. The dome of the hand holder comprises a unique configuration of and is particularly suitable to the wall decorating art for simulating the look of wall paper.

A two piece, preferably hand held, device is taught comprising an ergonomic and ambidextral hand holder having a removable imprinting element attached thereto. The imprinting element is preferably made of a unitary, resilient, self-restoring, sponge body, such as for example a sponge-like open celled polyurethane foamed plastic, having a imprinting surface with a desired ornamental image or design embossed therein. The imprinting surface is typically dipped into a paint or a slurry mixture and then pressed upon the wall surface causing the image to be transferred thereto.

The hand holder comprises an open ended, generally concave, "bowl-like" configuration having a planer flange circumscribing the periphery of the opening. The dome of the hand holder comprises a unique configuration of circumscribing protrusions having concave, finger receiving areas therebetween. Because of the unique arrangement of the protrusions, the dome of the hand holder comfortably fits either the right or left hand of the user in a multiple of hand held positions. Further, because of the unique configuration of the hand holder, the full surface of the user's palm may be used to apply the necessary image applying pressure, thereby preventing finger and/or hand cramps sometimes experienced by users of prior art devices.

The imprinting element is preferably one piece having a "mushroom-like" head, or top portion and a lower image imprinting portion containing the image printing face. The mushroom-like head is preferably configured to completely fill the internal volume of the concave hand holder whereby forces applied to the hand holder are compressively transmitted through the imprinting element's body to the printing face. A circumscribing peripheral groove is provided at the juncture of the mushroom-like head and the imprinting portion of the imprinting element. The groove lockingly receives therein an inward projecting lip of the hand holders peripheral flange thereby, removably, attaching the imprinting element to the hand holder. Thus, the imprinting element may be easily removed from the hand holder for cleaning and/or replacement.

DETAILED DESCRIPTION OF THE PREFERRED EMBODIMENT

Figure 1:
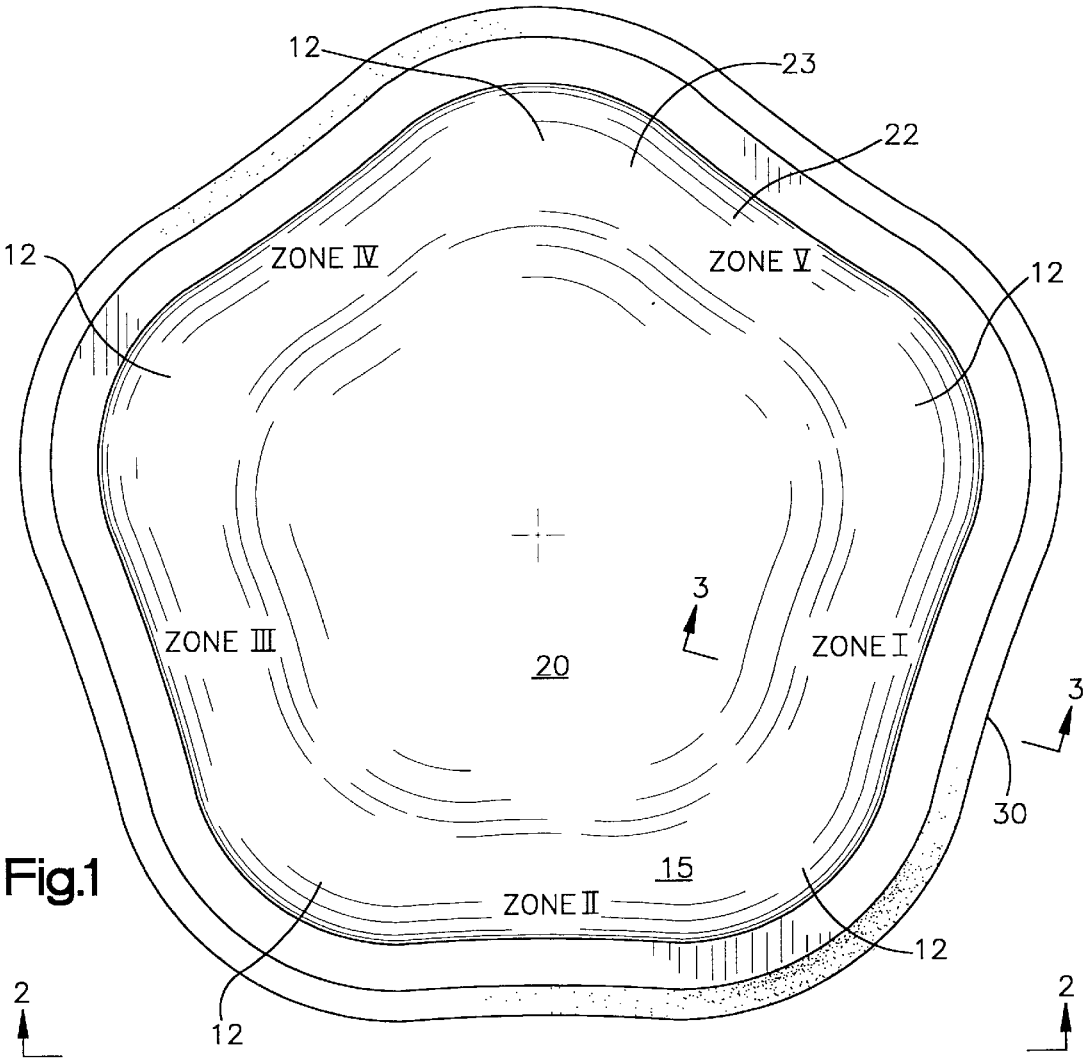
FIG. 1 is a top plan view of a wall decorating and imprint applying device constructed in accordance with the present invention.
Figure 2:
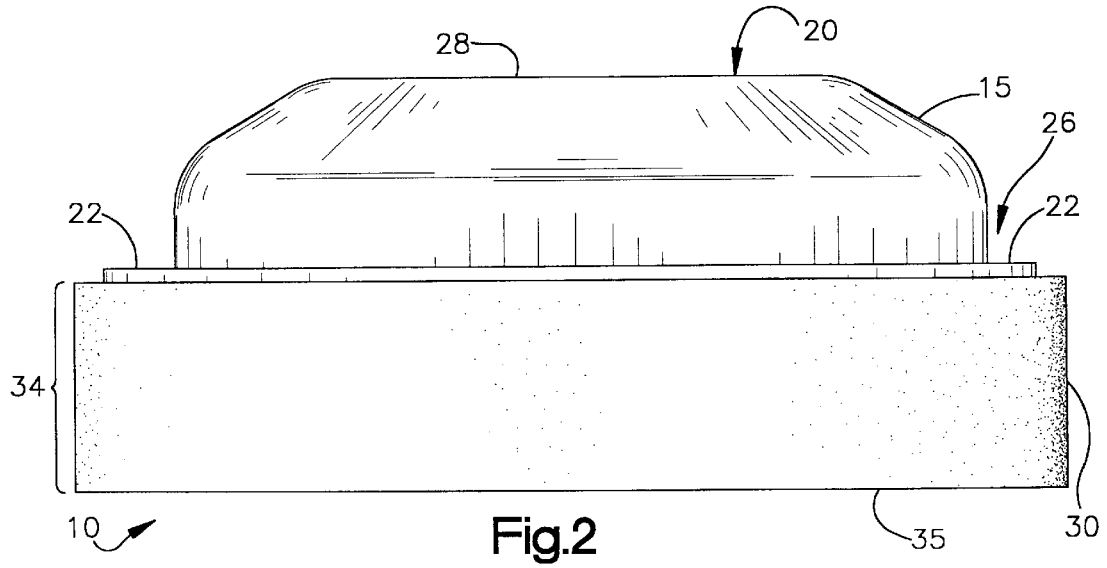
FIG. 2 is an elevational view of the paint applying device illustrated in FIG. 1.
Figure 3:
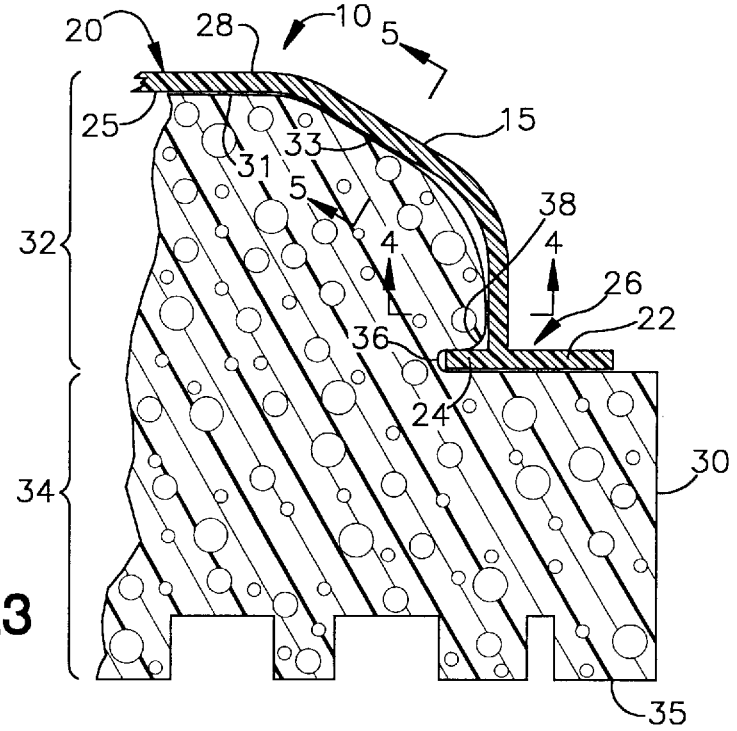
FIG. 3 is a cross sectional view taken along line 3—3 in FIG. 1 showing the internal structure of the present imprint applying device.

Referring to FIGS. 1, 2, and 3, a wall stenciling and/or imprinting apparatus 10, as illustrated, generally comprises a domed, shell-like, concave, hand holding device 20 having a resilient, self-restoring, sponge-like imprinting element 30 removably attached thereto. Imprinting element 30 may be made of any suitable, preferably unitary, sponge-like, resilient, self-restoring sponge body, such as for example an open cell, foamed synthetic resin material, such as polyurethane, or a combination of any other suitable materials or composite of materials as will be further described below.

Holding device 20 generally comprises an upper hollow domed portion 28 having a planer circumscribing rim or flange 26. Flange 26 includes a radially outward extending rim 22 and a radially inward extending lip 24 as best illustrated in FIG. 3. The outer surface of the holding device 20 is preferably provided with a textured surface that provides a non-slip grip for the user. Received within the hollow dome 28, of holding device 20, is imprinting element 30 which generally comprises a convex, mushroom-like, upper interlocking portion 32 and a lower pattern imprinting portion 34 with a relieved, design defining paint imprinting face 35 which is formed integrally therewith. One of the important features of the present invention is the construction and configuration of imprinting element 30's upper portion 32 as will be explained in more detail below.

As best illustrated in FIG. 3, dome 20 forms a radially inward extending ledge at the juncture of dome 20 and the inwardly extending lip 24 of flange 26. The interlocking portion 32 of imprinting element 30 is configured whereby, at least, the greater portion, or as more preferred the total volume of dome cavity 28, is filed by interlocking portion 32. Further, imprinting element 30 includes a circumscribing peripheral notch 36, integrally molded therein, at the juncture of element 30's interlocking portion 32 and its lower imprinting portion 34. Thus, when the interlocking portion 32 of element 30 is inserted into domed cavity 28 of holder 20, as illustrated in FIG. 3, the inwardly extending lip 24 of flange 26 engages peripheral notch 36 in element 30 thereby releasably affixing element 30 to holder 20.

Although the domed holder 20 may be of any desired configuration, for example generally of a hemi-spherical configuration rather than the asymmetrical configuration as illustrated herein (the asymmetrical configuration will be discussed at greater length below), it is preferred that the interlocking portion 32 of element 30 be in surface to surface contact with the inside surface 25 of dome 28. Thus as force is applied upon holder 20, an evenly distributed imprinting pressure is transferred from the inside surface 25 of dome 28, and from flange 26 of holder 20 through the sponge-like medium of imprinting element 30 and to the imprinting face 35 of imprinting element 30.

Preferably, the inside domed surface 25 of holder 20 and the corresponding external surface 33 of imprinting element 30 are correspondingly sloped with the maximum horizontal dimension of the interlocking portion of imprinting element 30's top most surface 31 being smaller than the bottom opening of holder 20 as defined by lip 24 of holder 20(See FIG. 3). Thus, as the interlocking portion 32 of imprinting element 30 is inserted into the domed cavity 28 of holder 20, the inwardly projecting lip 24 of flange 26, will easily pass downward over the circumscribing peripheral nose 38 and pop into peripheral notch 36 to lock imprinting element 30 into holder 20. Because of the generally circular configuration of holder 20 and imprinting element 30, a slight alternating clockwise and counterclockwise rotation of holder 20, relative to imprinting element 30, will facilitate inserting the interlocking portion 32 of imprinting element 30 into the domed cavity 28 of holder 20.

To remove imprinting element 30 from holder 20 one only needs to pull lip 24 of holder 20, upward over nose 38 of imprinting element 30 and imprinting element 30 is easily removed from the holder. Similar to attaching imprinting element 30 to holder 20, as described above, removal of imprinting element 30 from holder 20 may be further facilitated by alternately rotating holder 20 clockwise and counterclockwise with respect to imprinting element 30 as the imprinting element is removed from holder 20.

The imprinting element 30 generally is sized to slightly protrude past the outer edge of flange 26, as seen in FIG. 3 so that a painter can see the edge of the imprinting element as it is applied to the wall. It is also within the terms of the invention to size the outer circumferential surface of element 30.

While the imprinting element 30 is preferably used in conjunction with a holder 20, it is also within the terms of the present invention to use the imprinting element by itself for applying a design, such as with paint, onto a surface. In this case, the user can grip the imprinting element 30, typically with the fingers in the notch 36, with the palm of the hand resting on the external surface 33 so that a relatively evenly distributed pressure can be applied to the sponge-like medium of the imprinting element 30.

Although in the preferred embodiment of the present invention imprinting element 30 is taught as being of a unitary, one-piece sponge-like construction, it is also within the scope of the present invention, that imprinting element 30 may be a composite, multi-piece construction comprising an upper resilient body, for interlocking with holder 20, and a rubber-like imprinting surface or pad affixed to the resilient upper body.

Although the present invention advantageously relies on the imprinting element being removably and replaceably secured to the holder 20 through the interconnection of interlocking portion 32 of the imprinting element 30 with a structural portion of the holder, it is also within the terms of the invention to secure the upper, interlocking portion 32 of element 30 with surface to surface contact with the inside surface 25 of dome 28 by means such as for example, a Velcro strip attachment or a weak glue that allows for re-attachment.

Figure 6:
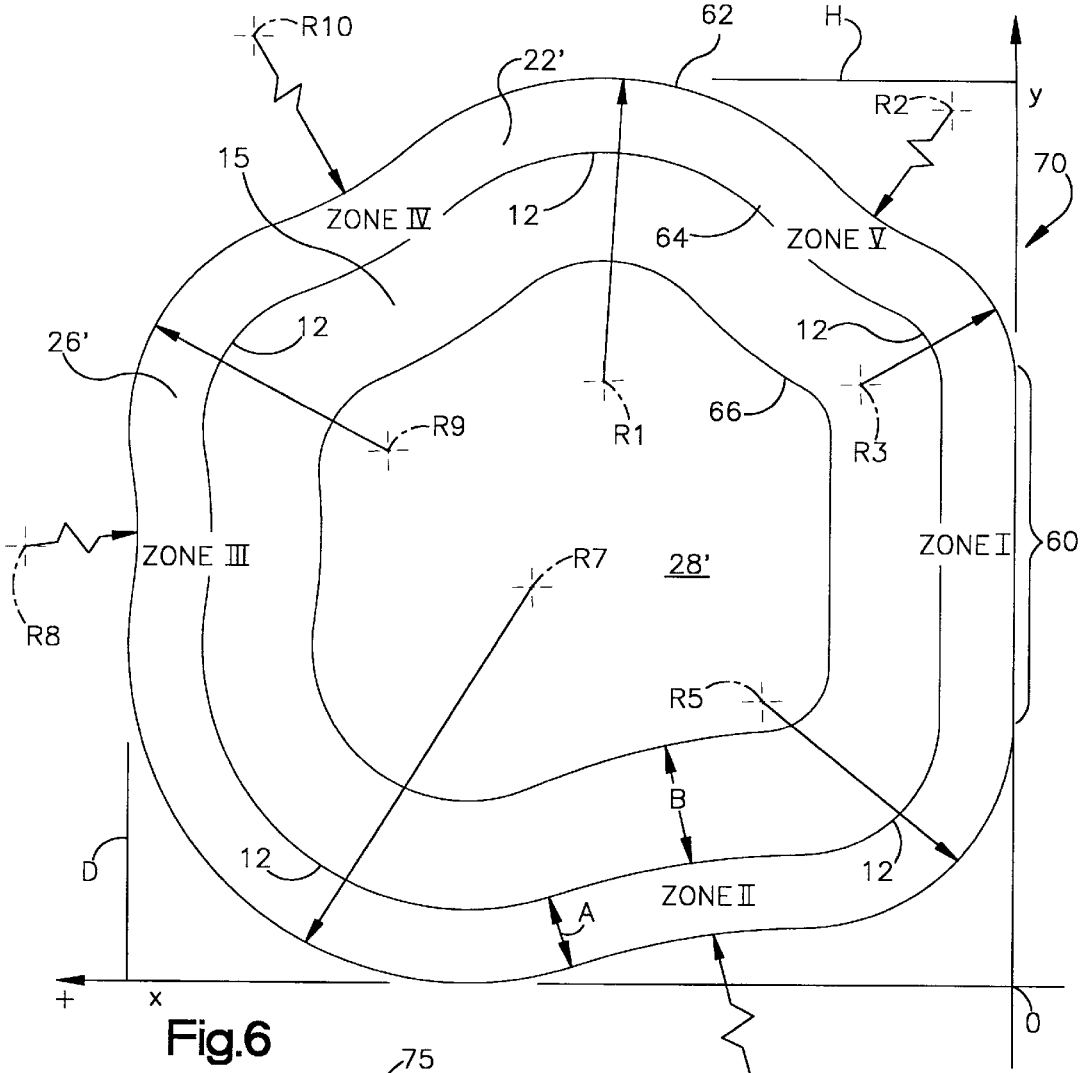
FIG. 6 presents a plan layout including horizontal and vertical axis, x and y, for identifying the location of various centers of curvature whereby the preferred asymmetrical configuration of the present invention may be constructed.

Now turning to FIG. 6, there is illustrated an example of a holder 20 constructed with a set of two dimensional coordinates having a horizontal axis x and a vertical axis y are defined with the plan form of holder 20 sketched within quadrant I of the coordinates. In the coordinate system as defined in FIG. 6, positive values are in the vertical direction for the y axis and positive values for the x axis are to the left of the origin 0.

The exemplary configuration, as illustrated in FIG. 6, and generally illustrated in the other figures, represents a unique, ambidextral, asymmetrical configuration that comfortably fits either the left or right hand in multiple hand positions. Five finger zones, I, II, III, IV, and V are defined by the five, knob-like, curved surfaces 12. Curved surfaces 12 are determined by radii R1, R3, R5, R7, and R9 as further explained below.

Figure 4:
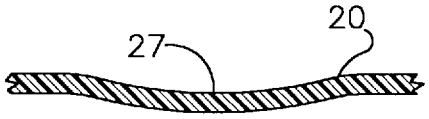
FIG. 4 presents a cross sectional view taken along line 4—4 in FIG. 3.
Figure 5:
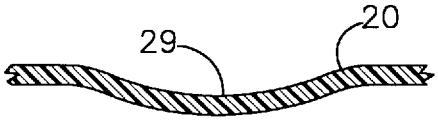
FIG. 5 presents a cross sectional view taken along line 5—5 in FIG. 3.

When holder 20 is held in the right hand the thumb comfortably rests in zone IV, the right index finger comfortably rests in zone V, the second and third fingers, together, comfortably rest in zone I, and the little finger comfortably rests in zone II. Similarly, when holder 20 is held in the left hand, the thumb comfortably rests in zone II, the index finger in zone I, the second and third fingers together in zone V and the little finger in zone IV. It is preferred that the portions of dome 28 extending between the curved sections 12 be slightly concave as illustrated, by depressions 27 and 29 in FIGS. 4 and 5, whereby the fingers and thumb of the hand will comfortably rest therein. While it has been found that the fingers and thumb of a user generally fits the handle as described before, it is within the terms of the invention for the user to grip the handle in any number of other positions.

Referring to FIG. 6, there is illustrated an exemplary holder 70 wherein the x and y dimensions as illustrated, are about 5.700 inches, designated by line D and 5.850 inches, as designated by line H. Thus the overall dimension of exemplary holder 70 is approximately six inches by six inches. The outer periphery of 62 of rim 26' is generally defined by radii R1 through R10 having the following locations and length within the coordinate system as shown:

| Radius | Length (inches) | Location (x,y) |
|---|---|---|
| R1 | 1.900 | (2.700, 3.95) |
| R2 | 3.000 | (0.670, 7.56) |
| R3 | 1.020 | (1.020, 3.85) |
| R5 | 1.635 | (1.640, 2.10) |
| R6 | 3.000 | (2.530, −1.19) |
| R7 | 2.730 | (3.085, 2.78) |
| R8 | 2.930 | (8.600. 2.93) |
| R9 | 2.030 | (3.850, 3.29) |
| R10 | | (not shown) |

Radius R1 is 1.900 inches and located such that the arc thereof smoothly blends with the arc of radius R1 and radius R9. Although section 60 of contoured outline 62, as seen in FIG. 6, may be curved inward as illustrated in FIG. 1, it is preferred that this section comprise a straight line, as illustrated in FIG. 6, thereby providing a locating key whereby the imprinting element 30 may be properly indexed or positioned when inserting it onto holder 70. Alternatively other means of indexing holders 20,70 and imprinting element 30 may be used such as an indexing mark, arrow, or the like may be integrally molded into or otherwise applied to rim 26,26'.

Contoured outline 62 generally defines the preferred outer periphery of rim 22' while contoured outline 64 generally defines the juncture of sloped surface 15 of dome 20' with rim 22' and contoured outline 66 generally defines the transition of the dome's top horizontal surface to the sloped surface 15. Throughout the specification, primed numbers represent structural elements which are substantially identical to structural elements represented by the same unprimed number.

It has been found that the operable dimensions A and B are preferably about 0.5 inches and 0.75 inches, respectively. Contoured outline 64 generally parallels contoured outline 62 and contoured outline 66 generally parallels contoured outline 64. Thus contoured outline 62, as defined by radii R1, R2, R3, R5, R6, R7, R8, R9, and R10 generally determines the overall shape, size, and configuration of a holder 20,70.

Referring to FIGS. 1, 3, 4, and 5, holder 20 is preferably provided with slightly curved or concave depressions 27 and 29 between each adjacent pair of knob-like protrusions 12 to comfortably receive therein the fingers, and/or thumb, thereby providing a comfortable, fit within the hand when gripped during use. In addition, a textured surface on holder 20 is provided to prevent slippage on the hand of the user.

Figure 7:
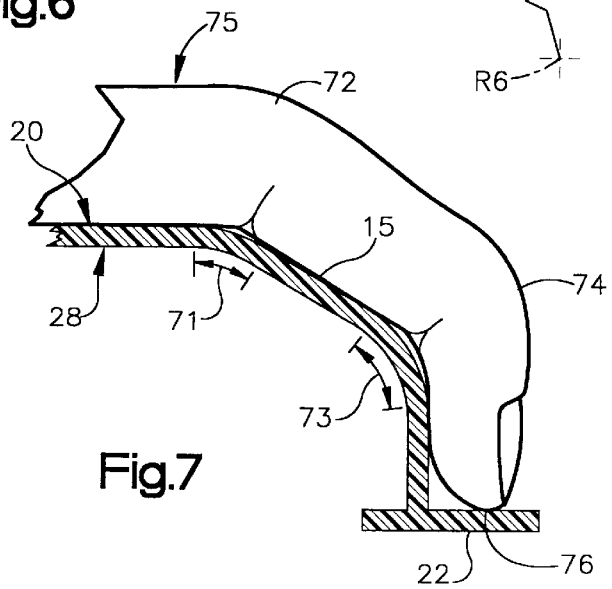
FIG. 7 presents an elevational view, similar to the elevational view of FIG. 3, illustrating the form fitting feature of the present invention with the human hand.

Referring now to FIG. 7, in an effort to further assure that holder 20 is form fitting to the human hand and comfortable therein when in use, the dome portion 28 of holder 20 is further configured such that with the palm of the human hand resting upon the top portion of the holder and with the fingers positioned within the finger zones as described above, the first contoured transition zone 71 of dome 28 is positioned such that the first knuckle 72 of the human finger 75 is approximately aligned therewith, and the second transition zone 73 similarly aligns with the second knuckle 74 with the finger tip 76 approximately resting upon rim 22. Thus by the structure as taught and disclosed herein the palm of either the right or left hand comfortably rests upon the top portion of dome 20 and the fingers naturally and comfortably wrap around transition zones 71 and 73. Of course, the same comfort of applying a human hand to grip holder 70 exists as with holder 20.

Although the preferred embodiment of the invention disclosed herein is primarily disclosed as an ergonomic hand held device, many of the unique features taught, such as the means for interchangeably replacing the imprinting element 30 within holder 20, 70 may also be embodied within other versions of such devices such as stenciling devices supported upon extended application poles or handles, etc. Thus it is evident that many alternatives, modifications, and variations of the present invention will be apparent to those skilled in the art in light of the foregoing teachings. Accordingly, the invention is intended to embrace all such alternatives, modifications and variations as fall within the spirit and scope of the appended claims.

We claim:

1. A device for applying an ornamental image upon a surface comprising:

a) a holder having an open end and a peripheral lip extending radially inward from said open end;

b) a resilient, self-restoring sponge-like body releasably attaching to said peripheral lip of said holder and an imprinting portion for applying said ornamental image upon said surface; and wherein said holder comprises a dome-like, concave configuration with the peripheral lip extending about its open end so that said lip attaches to a corresponding groove in said sponge-like body to mount said sponge-like body to said holder.

2. The device as claimed in claim 1 wherein said sponge-like body is configured to completely fill the internal volume of said dome-like, concave configuration of said holder.

3. The device as claimed in claim 1 wherein said lip of said holder extends radially inward of said holder.

4. A device for applying an ornamental image upon a surface comprising:

a) a holder, said holder comprising a dome-like, hollow, concave configuration having a circumscribing peripheral lip about its open end, wherein said lip attaches to a corresponding circumscribing peripheral groove in a resilient, self-restoring sponge-like body to mount said sponge-like body to said holder, said lip further extending outward beyond the outer periphery of said holder forming a circumferential rim there around; and b) the resilient, self-restoring sponge-like body having a first interlocking portion being releasably attached to said holder and a second imprinting portion for applying said ornamental image upon said surface.

5. The device as claimed in claim 4 wherein the outer circumferential periphery of said sponge-like body extends slightly beyond said circumferential rim.

6. A paint applying device for applying an ornamental design upon a wall surface comprising in combination:

a) an open end, hollow, bowl-like, hand held holder having a planer peripheral flange circumscribing the periphery of said open end, said flange including a radially inward extending lip portion and a radially outward extending rim portion;

b) a unitary compressible, self restoring sponge body having a first portion being removably attached to said holder and a second portion having a paint retaining and applying face, said face including relieved portions therein defining an ornamental design to be applied to said wall surface.

7. The paint applying device as claimed in claim 6 wherein said first portion for attaching said sponge body to said holder includes an integral groove circumscribing the periphery of said sponge body at the juncture of said first and second portions of said sponge body whereby said groove attachingly receives therein the lip of said holder.

8. The paint applying device as claimed in claim 6 wherein said holder is hemi-spherical.

9. The paint applying device as claimed in claim 6 wherein said holder is asymmetrical.

10. The paint applying device as claimed in claim 9 wherein said holder is ambidextral.

11. The paint applying device as claimed in claim 7 wherein said first portion of said sponge body is configured so as to completely fill an open internal volume of said holder.

12. The paint applying device as claimed in claim 10 wherein said hollow holder includes at least four knob-like protrusions, spaced about the periphery of said radially outward extending rim portion thereby defining areas therebetween for the receipt of the fingers and thumb of either the left or right hand.

13. The paint applying device as claimed in claim 12 wherein said areas between said knob-like protrusions are concave.

14. The paint applying device as claimed in claim 6 wherein said sponge body comprises an open celled, resinous foam material.

15. The paint applying device as claimed in claim 6 wherein said first portion of said sponge body completely fills the internal volume of said hollow, bowl-like, hand held holder when said sponge body is attached thereto.

16. The paint applying device as claimed in claim 6 wherein the outer circumferential periphery of said sponge body extends slightly beyond said circumferential rim.

17. The paint applying device as claimed in claim 6 wherein the sponge body is a multi-piece construction having an upper resilient body and a rubber-like imprinting pad affixed to the upper resilient body.

18. The paint applying device as claimed in claim 6 wherein the first portion for attaching said sponge body to said holder includes a Velcro strip attachment to secure the sponge to the holder.

* * * * *